United States Patent [19]

Leffler et al.

[11] 4,144,681

[45] Mar. 20, 1979

[54] INTERLOCKING BUILDING PANEL WITH ASSEMBLY FACILITATING HINGE

[75] Inventors: William T. Leffler, Gahanna; Bruce W. Hamler, Columbus; Stephen R. Spriggs, Grove City, all of Ohio

[73] Assignee: United McGill Corporation, Columbus, Ohio

[21] Appl. No.: 866,652

[22] Filed: Jan. 3, 1978

[51] Int. Cl.[2] ..... E02D 35/00

[52] U.S. Cl. ..... 52/127; 52/585; 52/593

[58] Field of Search ..... 52/582, 588, 585, 270, 52/271, 580, 127, 238, 593, 741, 745, 240, 241, 126, 122, 143

[56] References Cited

U.S. PATENT DOCUMENTS

| | | | |
|---|---|---|---|
| 3,742,672 | 7/1973 | Schaeufele | 52/582 X |
| 3,760,548 | 9/1973 | Sauer et al. | 52/588 X |

FOREIGN PATENT DOCUMENTS

| | | | |
|---|---|---|---|
| 2274748 | 1/1976 | France | 52/582 |

*Primary Examiner*—Price C. Faw, Jr.

*Assistant Examiner*—Carl D. Friedman

*Attorney, Agent, or Firm*—Mahoney & Stebens

[57] ABSTRACT

A modular type building panel for either vertical or horizontal positioning is provided having a hinge element incorporated to facilitate assembly of the panels. The building panels are of a double walled construction having tongue and socket edge configurations adapted to mechanically interlock when placed in assembled relationship with an adjacent panel. The hinge elements comprise a hinge socket and a hinge pin formed with the respective tongue edge portion and the socket edge portion. The hinge socket is disposed adjacent the upper end of the panel as is the hinge pin which permits interfitting of the two elements during the initial stage of panel assembly thereby providing a support pivot facilitating swinging of two panels into assembled relationship. In one embodiment the hinge socket opens at the longitudinal end of the panel for panels designed for vertical walls. In a second embodiment, the hinge socket is an elongated slot having a relatively narrow throat opening at a longitudinal side edge of the tongue-forming marginal edge portion of a panel designed for horizontal positioning.

24 Claims, 10 Drawing Figures

13c
14c
15c
19c
10c 11c
41
40
20c
42
43
16c
17c
16c
14c
15c
18c
21c
19c
11c
12c

INTERLOCKING BUILDING PANEL WITH ASSEMBLY FACILITATING HINGE

BACKGROUND OF THE INVENTION

This invention is directed to incorporation of hinge elements in a modular building panel of the type disclosed in U.S. Pat. No. 3,742,672 issued to H. J. Schaeufele on July 3, 1973. The building panel disclosed in that patent comprises a rigid double-walled structure formed from spaced parallel sheet metal skins and having elongated tongue and socket configurations forming opposed longitudinal edge portions thereof. The tongue portion also includes a locking groove extending longitudinally of the panel which interlocks with a locking bead formed with the socket portion when two adjacent panels are positioned in assembled relationship. The dimensions of the tongue and socket portions are maintained to cause slight flexing of the socket sidewall elements during assembly with the tongue. When the two panels are assembled, the locking bead then snaps into locking engagement with the groove.

While the structure disclosed in the aforementioned patent is a useful structure providing substantial economical savings in fabrication and erection of the building structures, these panels are necessarily of substantial size and present some difficulties in handling during assembly into either vertical walls or horizontal ceiling or roof sections of the building. It is a common practice to position two adjacent panels in coplanar relationship, either an upright position, or a horizontal position and they are then either slid horizontally together or pivoted into interlocking relationship where the technique of pivoting is utilized. For a vertical wall one corner at the bottom of a panel is initially placed in a bottom channel with the opposite corner then engaging the adjacent panel at a point upwardly spaced from the lowermost edge of the previously positioned panel. As the panel is then pivoted into position, the locking bead will move into engagement with the groove of the other panel at a point which may not coincide with the desired relative longitudinal position of the two panels. It is then necessary to slide the two panels, while interlocked, longitudinally with respect to each other into the desired longitudinally aligned position. While this technique accomplishes the assembly objectives, there is a disadvantage in that the caulking or sealing compound, or other type of sealing element, that must generally be utilized will be displaced from the locking groove and thereby result in air leaks which must be located and subsequently sealed. The technique of sliding the two panels laterally or edgewise into engagement, while not disrupting the caulking compound in the locking groove, does result in substantial disturbance of caulking compound that is placed in a base or curb channel. Additionally, a substantial number of workmen are required to manipulate the panels in accordance with this assembly technique as well as requiring additional mechanical equipment.

This invention provides panel structures with hinge elements to facilitate the assembly operation and reliably achieve a fluid impervious seal by eliminating subsequent relative panel movement necessary to achieve proper longitudinal alignment that could disturb prepositioned caulking compound, or other sealing element, in either the locking groove or in the curb channel. The hinge elements are formed in the panels intended for vertical positioning to enable a subsequent panel to be supported on a previously installed panel as the initial step in assembly. In the case of panels intended for horizontal positioning, the hinge elements are formed to provide a pivot point against which the one panel may be swung with relative longitudinal displacement. The pivotal movement which occurs about a pivot axis located at the extreme upper end of the panel effectively minimizes disturbance of the caulking compound, or other sealing element in either the locking groove or the base channel. Incorporation of a hinge element in accordance with this invention also materially and substantially reduces the physical forces required to manipulate the panels and reduces the necessity of additional mechanical equipment for forcing the panels into interlocking engagement.

These and other objects and advantages of this invention will be readily apparent from the following detailed description of the embodiments thereof and the accompanying illustrative drawings of these embodiments.

DESCRIPTION OF THE DRAWING FIGURES

DETAILED DESCRIPTION OF THE ILLUSTRATIVE EMBODIMENTS

Figure 1:
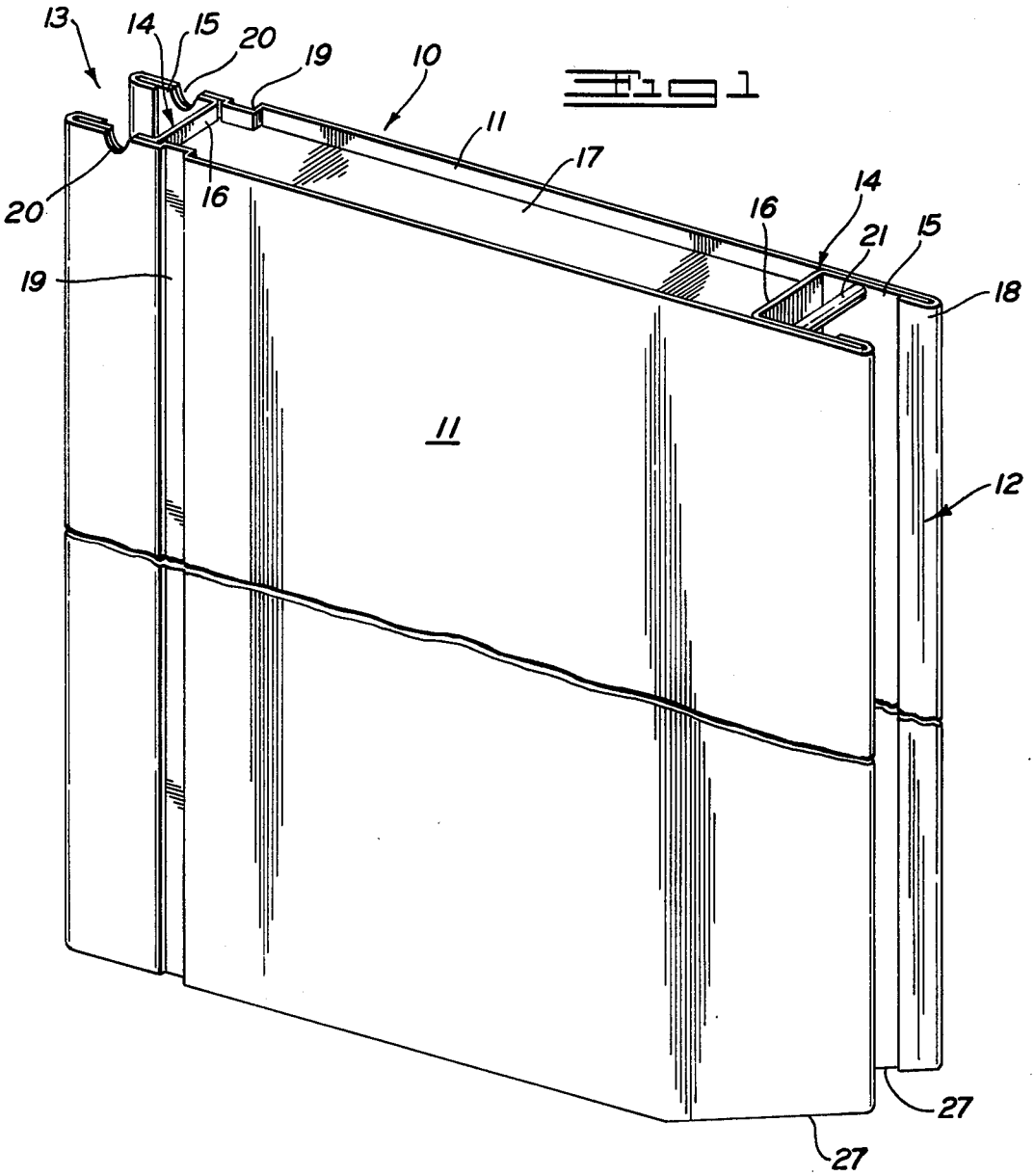
FIG. 1 is a perspective view of an interlocking building panel embodying this invention.
Figure 2:
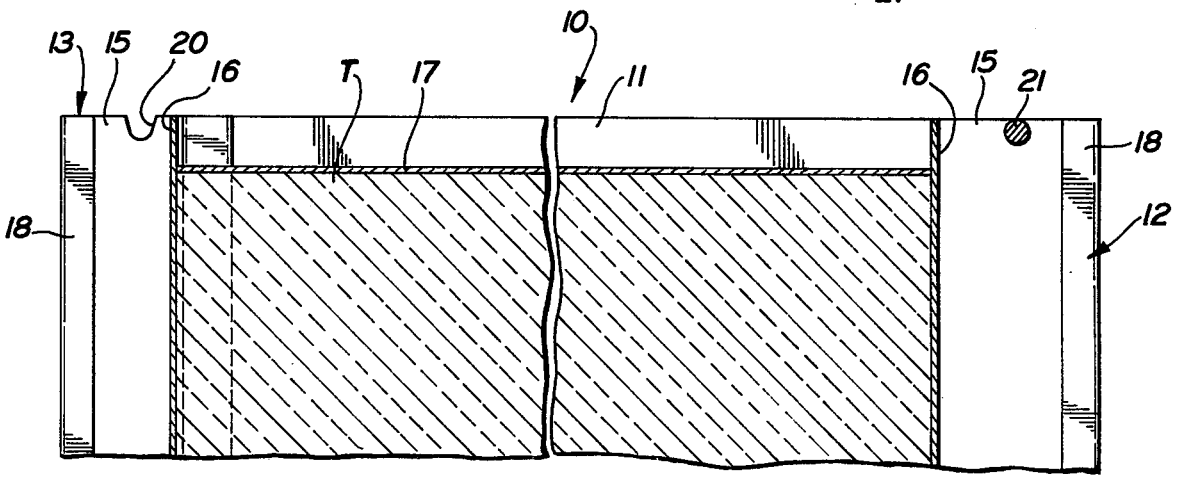
FIG. 2 is a fragmentary vertical sectional view on an enlarged scale of the upper portion of the panel.

A modular building panel 10 of substantially the same construction as that disclosed in U.S. Pat. No. 3,742,672 is shown in FIGS. 1 and 2. This panel is fabricated from two spaced parallel sheets 11 of thin metal which preferably have a thermal insulative material T interposed therebetween. The illustrated panel is intended for assembly into a vertical wall and is of rectangular configuration having a longitudinal dimension that is the modular building wall height with the width being equivalent to or a multiple of the building module dimensions. One longitudinal marginal edge portion of the panel forms a socket 12 while the other edge portion forms a tongue 13 that is dimensioned to interfit within the socket.

Interposed between the two sheets 11 along each longitudinal edge portion are respective channels 14 having sidewall flanges 15 disposed in contacting engagement with the adjacent portions of the sheets 11 and having the interconnecting webs 16 spaced inwardly thereby forming an open channel at each edge. Preferably, an end cap 17 is placed in each end of the panel for retention and protection of the insulative material. Longitudinal edge portions of the sheets 11 are turned inwardly over the channel flanges 15 for reinforcement of the panel and forming a locking bead 18 in the socket 12. A longitudinal groove 19 is formed in each sheet 11 inwardly of the channel web 16 associated with the tongue 13 providing a groove interlocking with the locking bead 18 when two adjacent panels are assembled with the tongue 13 inserted into a socket 12 of another panel.

In accordance with this invention, each panel 10 is provided with hinge elements to interfit with respective mating hinge elements of an adjacent panel. These hinge elements comprise a hinge socket 20 and a hinge pin 21. The hinge socket 20 is formed in the panel in the region of the tongue 13 at the top end of the panel while the hinge pin 21 is secured to the panel in the region of the socket 12. Both the hinge pin 21 and socket 20 are relatively positioned to the locking head 18 and groove 19, repsectively, to interfit when the bead and groove are interlocked. The hinge socket 20 comprises a pair of upwardly opening notches formed in the adjacently disposed panel sheets 11 and channel flanges 15 at about the midpoint of the channel depth. The bottom of each notch is arcuately curved and dimensioned to receive the hinge pin 21 which is a cylindrical rod that is secured at each end to the channel flanges 15 at a point where it will be coaxial with the socket 20 when two adjacent panels are assembled.

Figure 3:
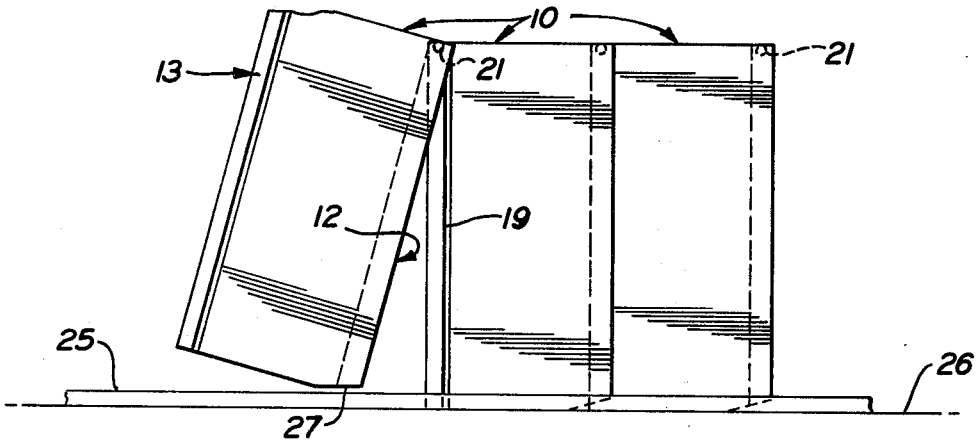
FIG. 3 is a diagrammatic illustration of the method for assembling panels of this invention.

Assembly of several panels 10 embodying this invention into a wall is diagrammatically illustrated in FIG. 3. In that Figure, two panels are shown assembled and positioned upright in a curb channel 25 which has been previously installed on a building floor 26. A third panel is then positioned as at the left side of FIG. 3 in angled relationship with the upper end of the socket 12 pushed onto the tongue 13. In this position the hinge pin 21 can be positioned in the socket 20 which is readily accomplished by initially assembling the two panels in the illustrated angular position but with the panel to be assembled at a slightly higher elevation to permit insertion of the tongue 13 into the socket 12 and enabling the hinge pin to pass over the top of the panel. When the tongue and socket are relatively inserted to the position where the hinge pin 21 is vertically above the hinge socket 20, the panel 10 is moved downwardly to seat the hinge pin in the hinge socket and which movement will occur prior to the bead 18 entering the groove 19.

At this point, the weight of the panel 10 is substantially carried by the previously installed panel. The workmen may then easily swing or pivot the panel into assembled relationship with the other panel about the pivot axis of the hinge elements 20 and 21. Assembly is completed when the locking bead 18 seats in the locking groove 19 with the base of the panel also being disposed in the curb channel 25. This assembly procedure enables preplacement of the necessary caulking compound or sealant in the locking groove prior to assembly of the panels thereby effecting economy in fabrication and does not result in any substantial disturbance of the caulking compound or sealing element during assembly.

It will also be noted that the bottom marginal end portion of the panel is positioned in the curb channel 25 and must often be effectively sealed by caulking compound preplaced in the curb channel. To reduce disturbance of this caulking while the panel 10 is being swung into position, the lower corner of the panel is preferably angled as at 27. This angle is relatively slight, not exceeding 30° relative to the base edge and not extending much beyond the region of the socket 12. This prevents the leading corner of the panel from scraping through the caulking until the panel is nearly assembled with the other panel and there will be a minimum of further relative movement of the adjacent panels in completing their assembly.

Figure 4:
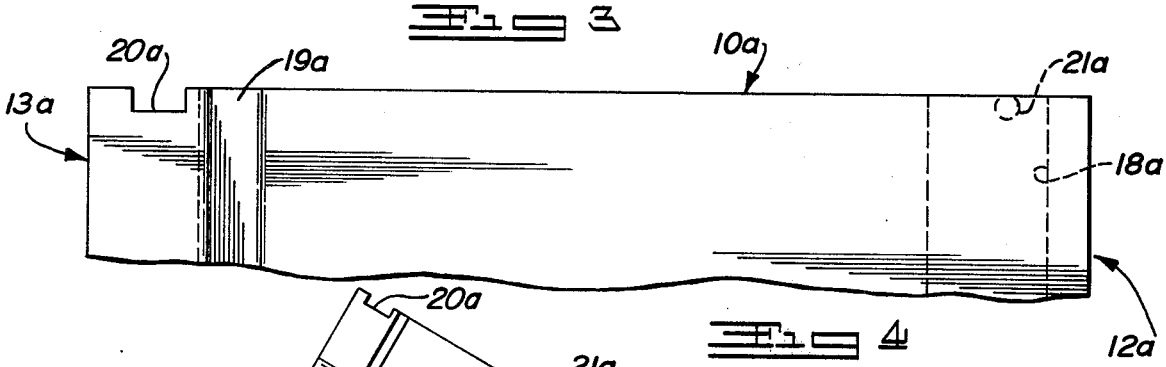
FIG. 4 is a fragmentary side elevational view on an enlarged scale of the upper portion of a modified panel.

A modified form of the hinge element is shown in FIG. 4 which permits the panels 10 to be first partially assembled through pivoting into a parallel position but not with the locking bead and groove interengaged. This enables the panels to be partially assembled but permitting the final locking to be deferred until several panels have been similarly assembled to assure that the longitudinal dimension of the wall as to the several panels is correct thereby taking advantage of any tolerance in panel width dimensions.

In this modified form, the hinge elements include a hinge socket **20*a* comprising an elongated notch extending laterally to the panel and which opens upwardly and is formed in the upper end of the panel 10*a* in the region of the tongue 13*a*. This elongated hinge socket 20*a* is of a length to permit sliding movement of the hinge pin 21*a* through a distance which is of the order of the width of the locking groove 19*a* and is located relative to the locking groove to maintain the bead 18*a*** out of locking engagement when the panels are initially swung together.

Figure 5:
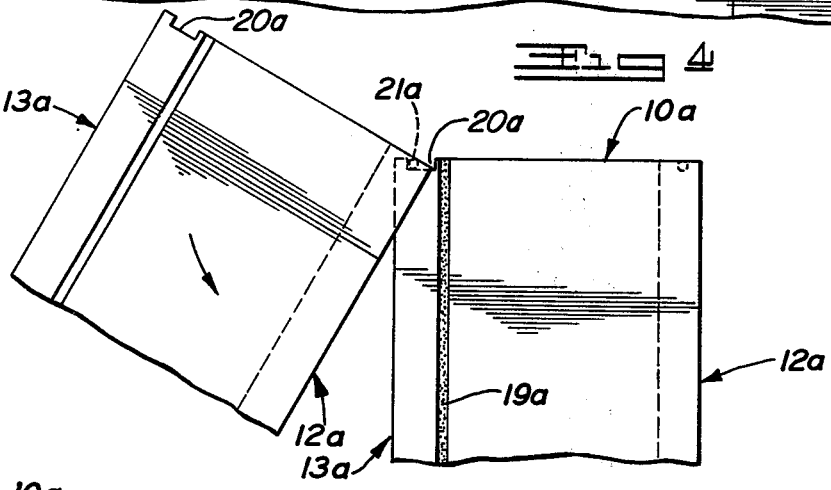
FIGS. 5, 6 and 7 are diagrammatic sequential illustrations of assembly of the modified panels of FIG. 4.
Figure 6:
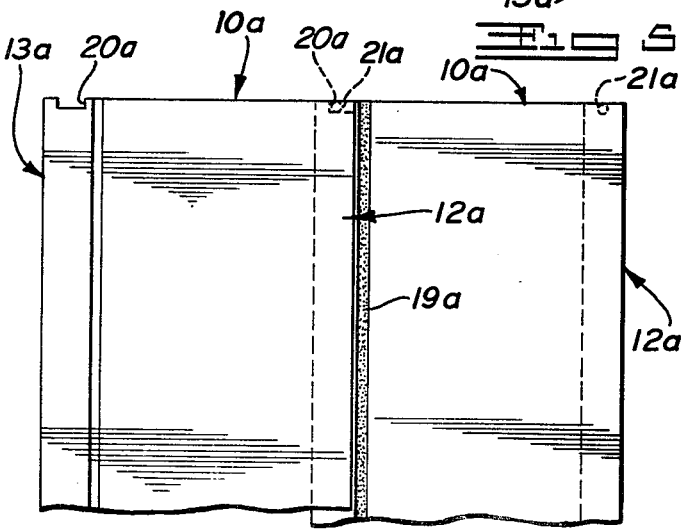
Figure 7:
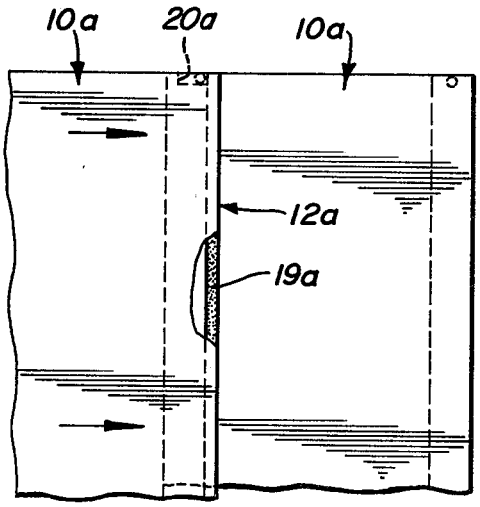

Assembly of the panels **10*a* provided with this modified hinge socket 20*a* is diagrammatically illustrated in FIGS. 5, 6 and 7. The initial step in assembly is shown in FIG. 5 with panel tongue 13*a* inserted in the socket 12*a* at the upper corner. The hinge pin 21*a* is positioned in the hinge socket 20*a* at the point furthest from the locking groove 19*a*. With the pin 21*a* maintained in this position, the panels are swung or pivoted together about this pivot point to the position shown in FIG. 6 with the locking groove 19*a* remaining exposed along with the caulking compound that would have been previously disposed therein. Subsequently, the two panels 10*a* are slid transversely of each other in an edgewise manner to move the locking bead 18*a* into the locking groove 19*a* as shown in FIG. 7** with the locking pin now being disposed at the opposite end of the hinge socket. This slight lateral movement does not materially disturb the caulking compound in the curb channel and enables the panels to be assembled without disturbance of the important seal at the locking bead and groove.

Figure 8:
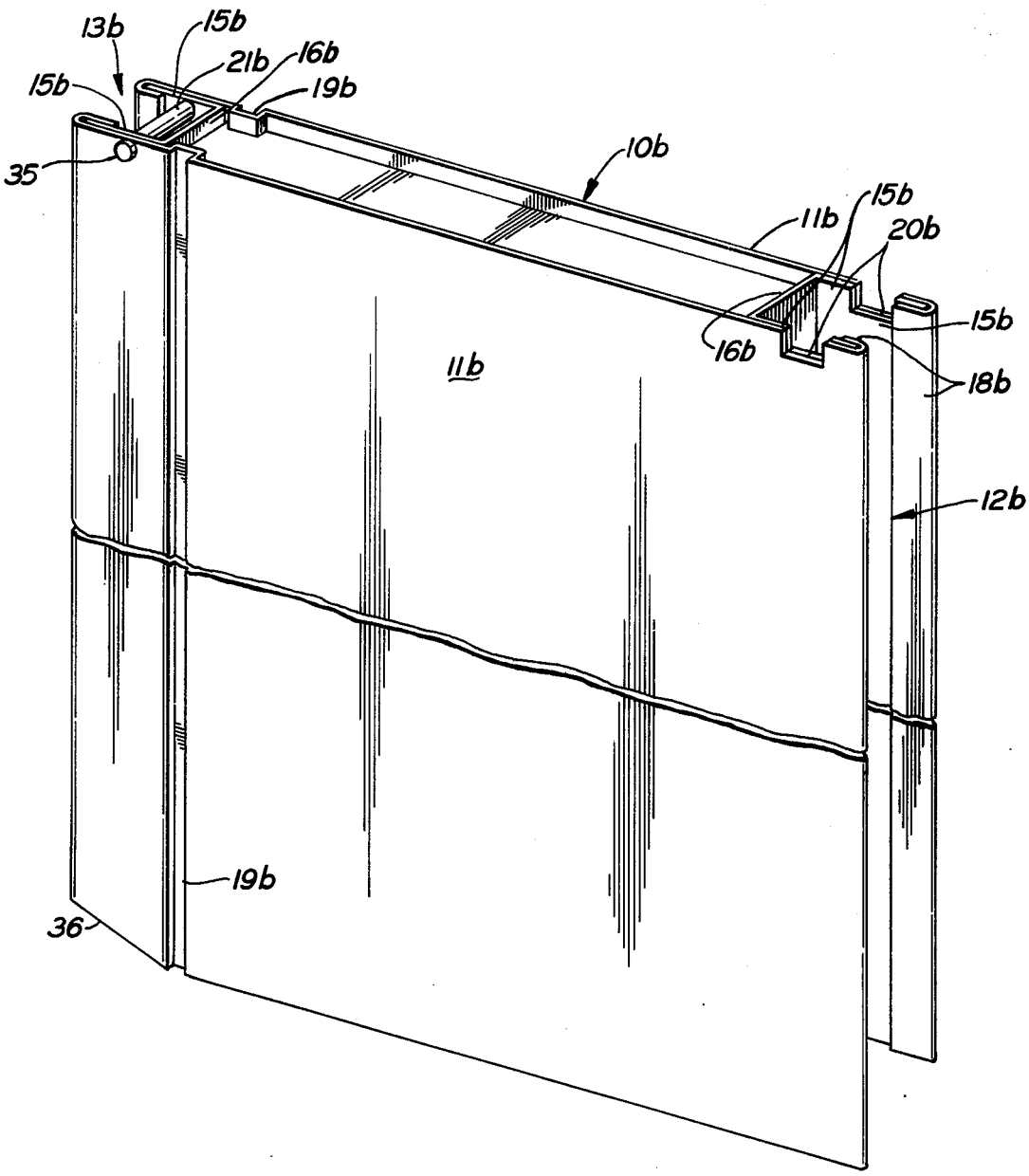
FIG. 8 is a perspective view of a modified panel.

A further modification of a panel **10*b* is shown in FIG. 8. In this panel, the hinge elements are interchanged with respect to the tongue 13*b* and socket 12*b*. The hinge socket 20*b* comprises a pair of upwardly opening notch recesses formed in the sidewall flanges 15*b* and panel sheets 11*b* at a point inward of the locking beads 18*b*. The hinge pin 21*b* is positioned in the upper end of the tongue 13*b* and extends transversely across the respective sidewall flanges 15*b* with marginal end portions 35 of the pin projecting a distance outwardly at either side of the panel. These end portions 35 project a distance sufficient to securely seat in the respective elements of the hinge socket 20*b***.

The lower ends 36 of the sidewalls of the tongue **13*b* may be angularly cut at an angle of about 30° to the bottom edge of the panel to provide adequate clearance during pivotal movement during assembly operations. Preferably, the angled corner ends 36 do not extend into the locking groove 19*b***.

This modified panel **10*b* shown in FIG. 8 may have an advantage over the previously described panels depending on the specific type of curb channel into which the panel bases may fit. This advantage in the case of a shallow curb channel is that the locking head 18*b* engages the locking groove 19*b*** throughout its entire length. A more complete seal can thus be effected in the case of installations involving shallor curb channels although the assembly operations remain the same as previously described.

Figure 9:
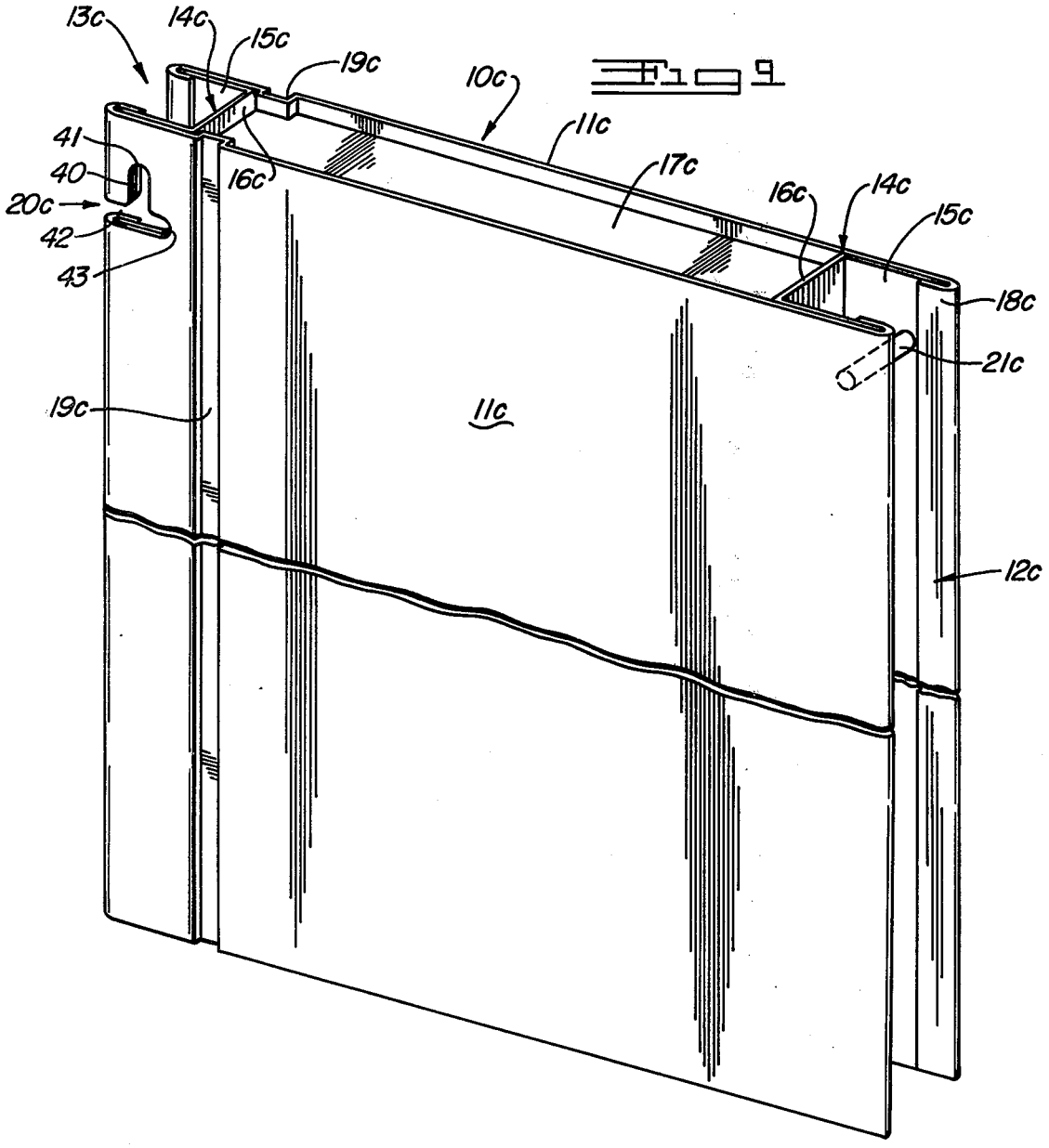
FIG. 9 is a perspective view of a modified panel designed for assembly in a horizontal plane.

A further modification of the panel is shown in FIG. 9 and differs from those previously described and illustrated in that the hinge socket designated 20c is formed as an elongated, closed end slot extending longitudinally of the panel and having a lateral opening and is disposed a distance inwardly of an extreme end of the panel. Similar numbers with appropriate subscript "c" are applied to FIG. 9 to denote the same similar components as described in previous embodiments. Accordingly, it will be seen that the hinge socket 20c is formed in panel sheets 11c and flanges 15c of the tongue 13c and includes an elongated slot 40 which terminates in arcuately curved end portion 41. Connecting with the elongated slot 40 at the end thereof furtherest from the adjacent end of the panel is a laterally extending entrance throat 42 which opens at the extreme longitudinally extending edge of each sidewall of tongue 13c. Secured in the opposite side of the panel, specifically the socket 12c, is the hinge pin 21c which is located in longitudinally spaced relationship to the end of the panel in accordance with the longitudinal spacing of the hinge socket 20c. The specific location is such that two adjacently disposed panels may be preliminarily assembled and interconnected in angular relationship with the hinge pin 21c inserted through the throat 42 and the panel 10c pushed longitudinally relative to the other panel to force the hinge pin against the upper arcuate end 41 of the slot. When thus assembled, relative longitudinal movement of the two partially assembled panels is resisted and the one panel may be easily pivoted with respect to the other panel. Wherein the elongated slot 40 is only of a width substantially equal to the diameter of the hinge pin 21c, the slot is positioned in spaced parallel relationship to the groove 19c so that when the two panels are pivoted to a parallel position, the beads 18c of the socket will be interlocked in the respective grooves 19c. With this positioning of the slot 40, a second panel 10c is readily assembled with another as the second panel is not restrained against relative longitudinal movement but is also restrained against lateral movement at the pivot point. The feature is of material advantage where the panels are being assembled in a horizontal plane.

Where it is desired that the panel be assembled in two steps and obtain the advantage of the elongated hinge socket, such as that of 20a and 20b in the configurations shown in FIGS. 4 and 8, the socket may be formed with an auxiliary or lateral slot 43 which projects a distance further inward of the longitudinal tongue edge. This lateral slot 43 may be oriented in aligned relationship with throat 42 and thus, when the panel is assembled by the technique as described in association with the modification shown in FIGS. 4 and 8 and the two panels have been aligned longitudinally, the final assembly step then comprises the edge-wise, lateral displacement of the two panels forcing the hinge pin 21c into the lateral socket 43. Utilizing this two-step assembly technique requires that the panels be displaced longitudinally after pivoting to bring the hinge pin 21c to the bottom of the slot 40 and in alignment with the lateral slot 43. The dimensions are such that, upon completing the lateral displacement of the panels, the beads 18c will be interlocked into respective grooves 19c.

Figure 10:
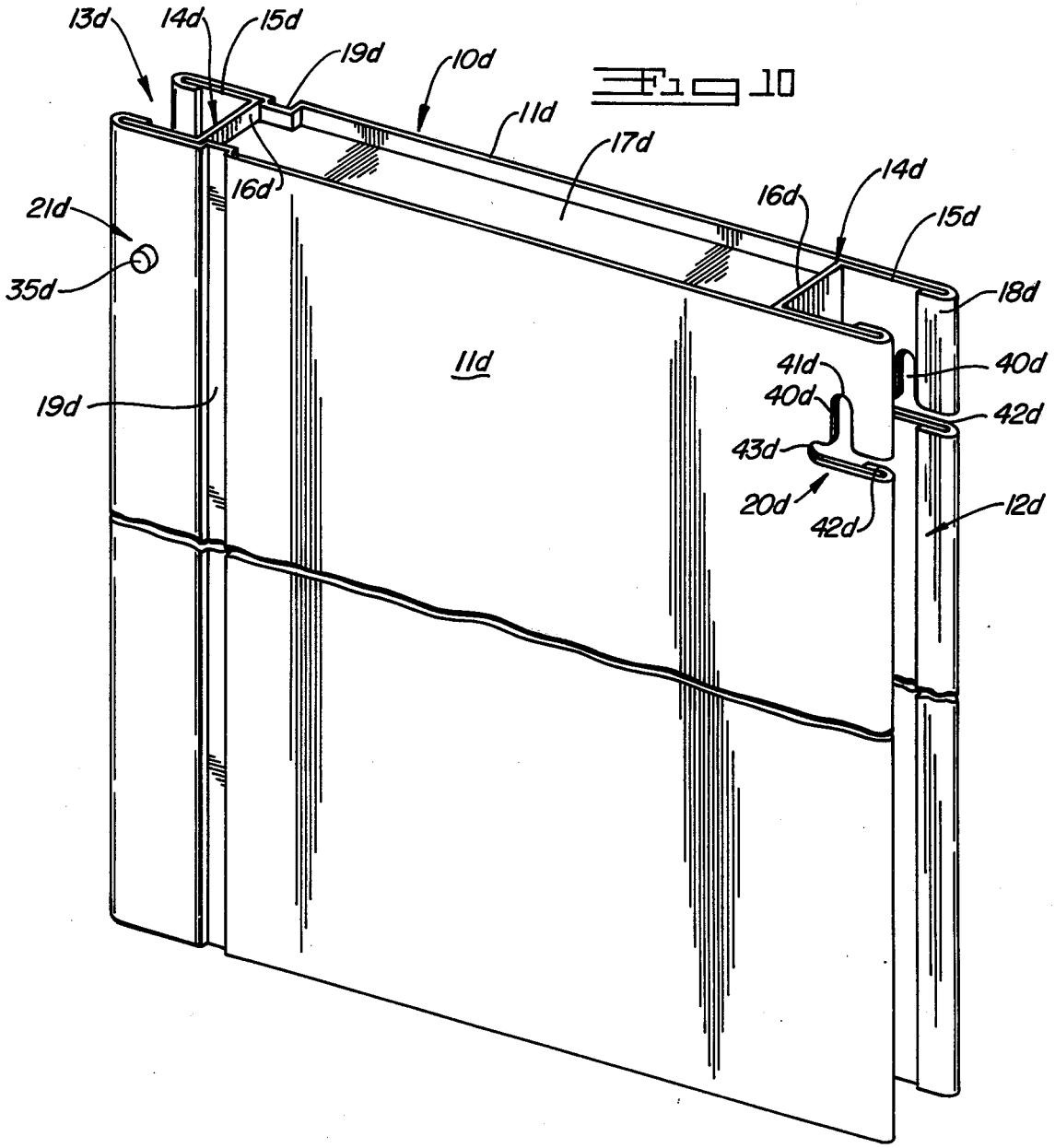
FIG. 10 is a perspective view of another modified panel designed for assembly in a horizontal plane.

A further modification of the panel is shown in FIG. 10 which embodies a hinge structure similar to that of FIG. 9. The difference is that the hinge socket 20d is formed in panel sheets 11d and flanges 15d of the socket 12d and the hinge 21d is carried by the tongue 13d. The hinge socket 20d is of a similar configuration having an elongated slot 40d with an arcuately curved interior end portion 41d. An entrance throat 42d communicates with the slot at its opposite end and the hinge socket may also include the lateral slot 43d. Carried by the tongue 13d is the hinge pin 21d which has axial extensions 35d that project a distance laterally outward with respect to the outer surface of the tongue in the manner of and for the purposes as described in conjunction with the modification shown in FIG. 8. Utilization of the panel 10d will be substantially as described with reference to the panel 10c of FIG. 9.

Although the modifications of the panels 10c and 10d, as shown in FIGS. 9 and 10, are particularly adapted to facilitating assembly of the panels in a horizontal plane, it will be understood that the panels of FIGS. 1, 4 and 8 may also be assembled in horizontal planes. The panels 10, 10a and 10b may be assembled in a horizontal plane by installing a first panel with the hinge pin thereof being operative to form a fixed fulcrum or pivot for the next panel. However, the panels having hinge sockets opening at the end of the panel do not offer the secure pivoting that can be obtained with the panels of FIGS. 9 and 10.

It will be readily apparent that a novel modular building panel is provided having hinge elements which materially aid assembly of the panels into a building wall. The hinge elements provide a pivot support for a panel during assembly which greatly simplifies the operation and the panel assembly does not disturb the caulking compound or sealing elements so as to result in leaks. Assembly is thus made more economical with respect to the number of workmen and type of equipment required and better assures obtaining of a fluid impervious seal.

Having thus described this invention, what is claimed is:

1. A modular building panel comprising a structurally rigid, elongated panel having opposed, longitudinally extending, marginal edge portions of mating configuration forming a respective tongue and socket adapted to interfit edgewise with a respective socket and tongue of an adjacent panel, and hinge means formed with said panel at one end thereof enabling hinged interconnection of a panel with an adjacent panel permitting relative swinging movement in the plane of the panels into interfitting, edgewise engagement of a tongue and socket, said hinge means including a hinge pin and hinge socket with pivot axes disposed transverse to the plane of the panel and assembled by relative displacement of two adjacent panels in the same plane.

2. A modular building panel according to claim 1 wherein said hinge socket opens longitudinally outward at an end of said panel.

3. A modular building panel according to claim 2 wherein said hinge socket is formed with an arcuately curved surface for cooperatively receiving a hinge pin in relative rotative engagement therewith.

4. A modular building panel according to claim 3 wherein said hinge pin is formed with an arcuately curved surface which is cooperatively journalled in the arcuate curved surface of said hinge socket.

5. A modular building panel according to claim 1 wherein said hinge pin is formed with said tongue and said hinge socket is formed with said socket.

6. A modular building panel according to claim 5 wherein said panel is formed with an end portion thereof opposite said hinge pin inclined longitudinally inward from said end portion to a longitudinal edge of said socket.

7. A modular building panel according to claim 5 wherein said panel is formed with an end portion thereof opposite said hinge socket inclined longitudinally inward from said end portion to a longitudinal edge of said socket.

8. A modular building panel according to claim 1 wherein said hinge pin is formed with said socket and said hinge socket is formed with said tongue.

9. A modular building panel according to claim 8 wherein said panel is formed with an end portion thereof opposite said hinge pin inclined longitudinally inward from said end portion to a longitudinal edge of said socket.

10. A modular building panel according to claim 8 wherein said panel is formed with an end portion thereof opposite hinge socket inclined longitudinally inward from said end portion to a longitudinal edge of said tongue.

11. A modular building panel according to claim 1 wherein said socket and tongue each include a pair of spaced flanges, said hinge pin carried by one of said pair of flanges in transversely extending relationship thereto.

12. A modular building panel according to claim 1 wherein said hinge pin is carried by said tongue and includes opposite end portions which project a distance outwardly from either side of said tongue.

13. A modular building panel according to claim 1 wherein said tongue is formed with a longitudinally extending locking groove disposed a predetermined distance inwardly of a longitudinal edge of said tongue and said socket is formed with a longitudinally extending locking bead, said bead and groove relatively positioned to interfit in interlocking relationship as between adjacently disposed assembled panels, said hinge pin and hinge socket disposed in predetermined lateral relationship to said locking groove and bead to remain in assembled relationship when two adjacent panels are assembled with a respective groove and bead interlocked.

14. A modular building panel according to claim 13 wherein said hinge socket opens longitudinally outward at an end of said panel and is an elongated slot extending laterally with respect to the panel permitting displacement of a hinge pin therein between a first position where a respective bead and groove of adjacently disposed assembled panels are interlocked and a second position where the respective tongue and socket are in interfitting engagement but with bead and groove out of interlocking engagement.

15. A modular building panel according to claim 14 wherein said socket is of channel form opening laterally outward of the panel and having spaced flanges extending longitudinally of the panel to receive a tongue of an adjacent panel disposed in assembled relationship thereto.

16. A modular building panel according to claim 15 wherein said hinge socket is formed in said socket flanges and said hinge pin is carried by said tongue and includes opposite end portions projecting a distance outwardly from either side of said tongue to interfit in respective portions of said hinge socket formed in said socket flanges.

17. A modular building panel according to claim 15 wherein said tongue is of channel form opening laterally outward of the panel and having spaced flanges extending longitudinally of the panel with said hinge socket formed in said tongue flanges, said hinge pin carried by said socket flanges and extending transversely therebetween.

18. A modular building panel according to claim 13 wherein said hinge socket includes an elongated slot with closed ends extending longitudinally of the panel and is disposed a predetermined distance inwardly of one end of the panel, said hinge socket including an entrance throat communicating with said slot and opening laterally at a longitudinal side edge of the panel for passage of a hinge pin of an adjacent panel into and out of said slot.

19. A modular building panel according to claim 18 wherein said entrance throat communicates with said slot in longitudinally spaced relationship to one end thereof.

20. A modular building panel according to claim 18 wherein said slot is of a width to restrict movement of a hinge pin disposed therein to longitudinal displacement.

21. A modular building panel according to claim 20 wherein said slot is spaced a predetermined distance laterally inward of said longitudinal edge whereby the bead and groove of two adjacent panels will interlock when assembled.

22. A modular building panel according to claim 20 wherein said slot is spaced a predetermined distance laterally inward of said longitudinal edge whereby the bead and groove of two adjacently disposed panels will not interlock when a hinge pin of the one panel is disposed in said slot, said hinge socket including a lateral slot communicating with said elongated longitudinally extending slot, said lateral slot extending a further distance laterally inward of said panel longitudinal edge whereby the bead and groove will interlock when a hinge pin of the one panel is disposed in said lateral slot.

23. A modular building panel according to claim 18 wherein said hinge socket is formed in said tongue and said socket is of channel form opening laterally outward of the panel and having spaced flanges extending longitudinally of the panel to receive a tongue of an adjacent panel disposed in assembled relationship thereto, said hinge pin carried by said socket flanges and extending transversely therebetween.

24. A modular building panel according to claim 18 wherein said socket is of channel form opening laterally outward of the panel and having spaced flanges extending longitudinally of the panel to receive a tongue of an adjacent panel disposed in assembled relationship thereto, said hinge socket being formed in said socket flanges, said tongue carrying said hinge pin which includes opposite end portions projecting a distance outwardly from either side of said tongue to interfit in respective portions of said hinge socket formed in said socket flanges.

* * * * *